US006851774B2

(12) United States Patent
Chen et al.

(10) Patent No.: US 6,851,774 B2
(45) Date of Patent: Feb. 8, 2005

(54) RETAINING STRUCTURE FOR A TRACK DEVICE FOR DRAWERS

(75) Inventors: Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/379,706

(22) Filed: Mar. 6, 2003

(65) Prior Publication Data

US 2004/0174104 A1 Sep. 9, 2004

(51) Int. Cl.[7] ..... A47B 88/16

(52) U.S. Cl. ..... 312/334.47; 312/334.44; 312/334.46

(58) Field of Search ..... 312/334.47, 334.44, 312/334.46

(56) References Cited

U.S. PATENT DOCUMENTS 4,549,773 A * 10/1985 Papp et al. ..... 312/334.47 X
4,560,212 A * 12/1985 Papp et al. ..... 312/334.47 X
5,417,490 A * 5/1995 Hobbs et al. ..... 312/334.47
5,542,759 A * 8/1996 Krivec ..... 312/334.47 X
5,730,514 A * 3/1998 Hashemi ..... 312/334.47 X
6,220,683 B1 * 4/2001 Chu ..... 312/334.47 X
6,367,899 B1 * 4/2002 Hwang et al. ..... 312/334.47
6,412,891 B1 * 7/2002 Liang et al. ..... 312/334.44
6,502,910 B2 * 1/2003 Kuo-Chan ..... 312/334.46 X
2002/0089274 A1 * 7/2002 Liang et al. ..... 312/334.44
2002/0117948 A1 * 8/2002 Le ..... 312/334.44 X
2003/0141791 A1 * 7/2003 Dubon et al. ..... 312/334.44 X
2003/0178922 A1 * 9/2003 Chen et al. ..... 312/334.47 X

* cited by examiner

*Primary Examiner*—Rodney B. White
(74) *Attorney, Agent, or Firm*—Bacon & Thomas

(57) ABSTRACT

A track device includes a first track, a second track slidably received in the first track, a stop member fixed on the first track, a limiting member pivotally mounted to the second track and including two cams for respectively releasably engaging with two stops of the stop member, and a connecting rod mounted on the second track. When a user manually operates the connecting rod to move the limiting member from the latching position to the unlatching position, a safety element on the limiting member comes in contact with one of the stops of the stop member when the second track is moved from the extended position into the first track and when the connecting rod is pulled, thereby preventing injury to the user's fingers that grasp the connecting rod.

11 Claims, 5 Drawing Sheets

RETAINING STRUCTURE FOR A TRACK DEVICE FOR DRAWERS

BACKGROUND OF THE INVENTION

1. Field of the Invention

The present invention relates to a retaining structure for a track device for drawers.

2. Description of Related Art

FIGS. 1 and 2 of the drawings illustrates a conventional track device with a retaining structure. The track device includes a first track 11 having a stop member 21 mounted thereon and a second track 12 having a limiting member 22 mounted thereon. The stop member 21 includes two stops 211 and 212. The limiting member 22 is pivotally mounted on the second track 12 and includes two cams 221 and 222 for respectively cooperating with the stops 211 and 212. A slide-aiding member 13 is mounted between the first track 11 and the second track 12, allowing smooth sliding movement between the first track 11 and the second track 12. The limiting member 22 further has a groove 223 for cooperating with a release cam 231 of a connecting rod 23 and an elastic element 24, thereby allowing the limiting member 22 to be manually switched from a latching position to an unlatching position.

When the second track 12 is moved to an extended position, the cams 221 and 222 of the limiting member 22 selectively engage with the stops 211 and 212, providing a retaining function in either direction. When the user manually pulls an operative end 232 of the connecting rod 23 outward, the engagement between the respective cam 221, 222 and the respective stop 211, 212 is released, allowing the second track 12 to be moved back into the first track 11, as shown in FIG. 2. However, it is not uncommon that the user forgets to remove his or her fingers such that the user's fingers moves inward along with inward movement of the second track 12. As a result, the fingers of the user are injured.

OBJECTS OF THE INVENTION

An object of the present invention is to provide a track device that avoids the risk of injury to the user's fingers while moving the second track into the first track.

SUMMARY OF THE INVENTION

To achieve the aforementioned objects, the present invention provides a track device comprising a first track, a second track slidably received in the first track, a stop member fixed on the first track and including two stops, a limiting member pivotally mounted to the second track and including two cams for respectively releasably engaging with the stops of the stop member, a safety element being provided between the cams of the limiting member, and a connecting rod mounted on the second track. The connecting rod is operatively connected to the limiting member for switching the limiting member between an unlatching position and a latching position.

When the second track is located in an extended position relative to the first track, the cams of the limiting member are respectively engaged with the stops of the stop member for preventing the second track from being moved relative to the first track in either direction. When a user manually operates the connecting rod to move the limiting member from the latching position to the unlatching position, the safety element of the limiting member comes in contact with one of the stops of the stop member when the second track is moved from the extended position into the first track and when the connecting rod is pulled. Thus, the risk of injury to the user's fingers that grasp the connecting rod is avoided while moving the second track into the first track.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
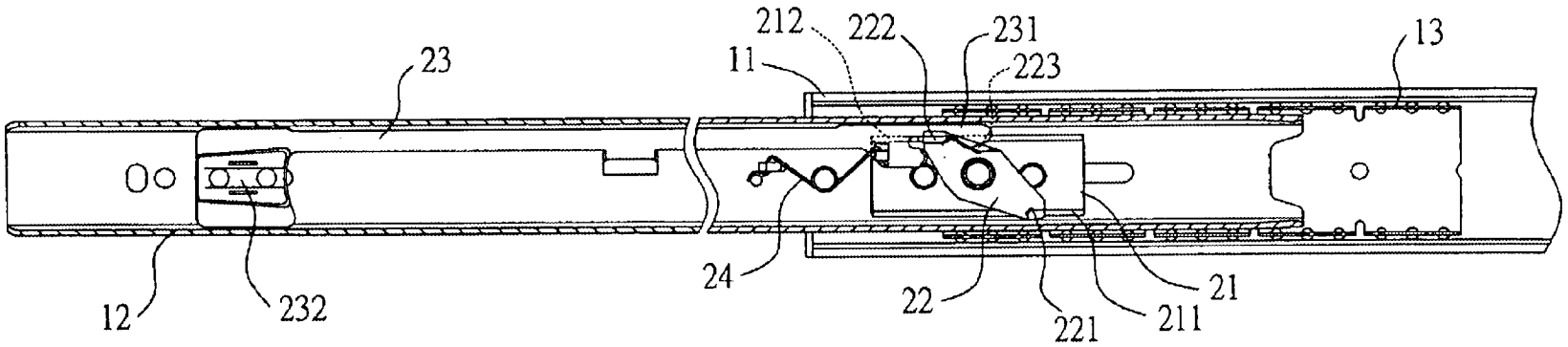
FIG. 1 (PRIOR ART)
FIG. 1 is an elevational view of a conventional track device for drawers, the elements for retaining purposes being shown by solid lines for clarity.
Figure 2:
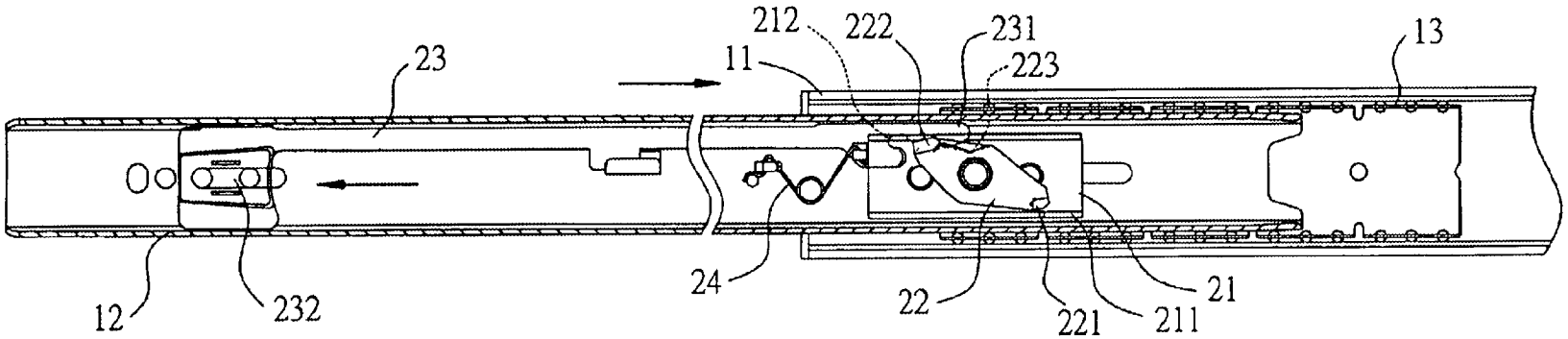
FIG. 2 (PRIOR ART)
FIG. 2 is a view similar to FIG. 1, illustrating operation of the track device.

The present invention is now to be described hereinafter in detail, in which the same reference numerals are used for the same parts as those in the prior art.

Figure 3:
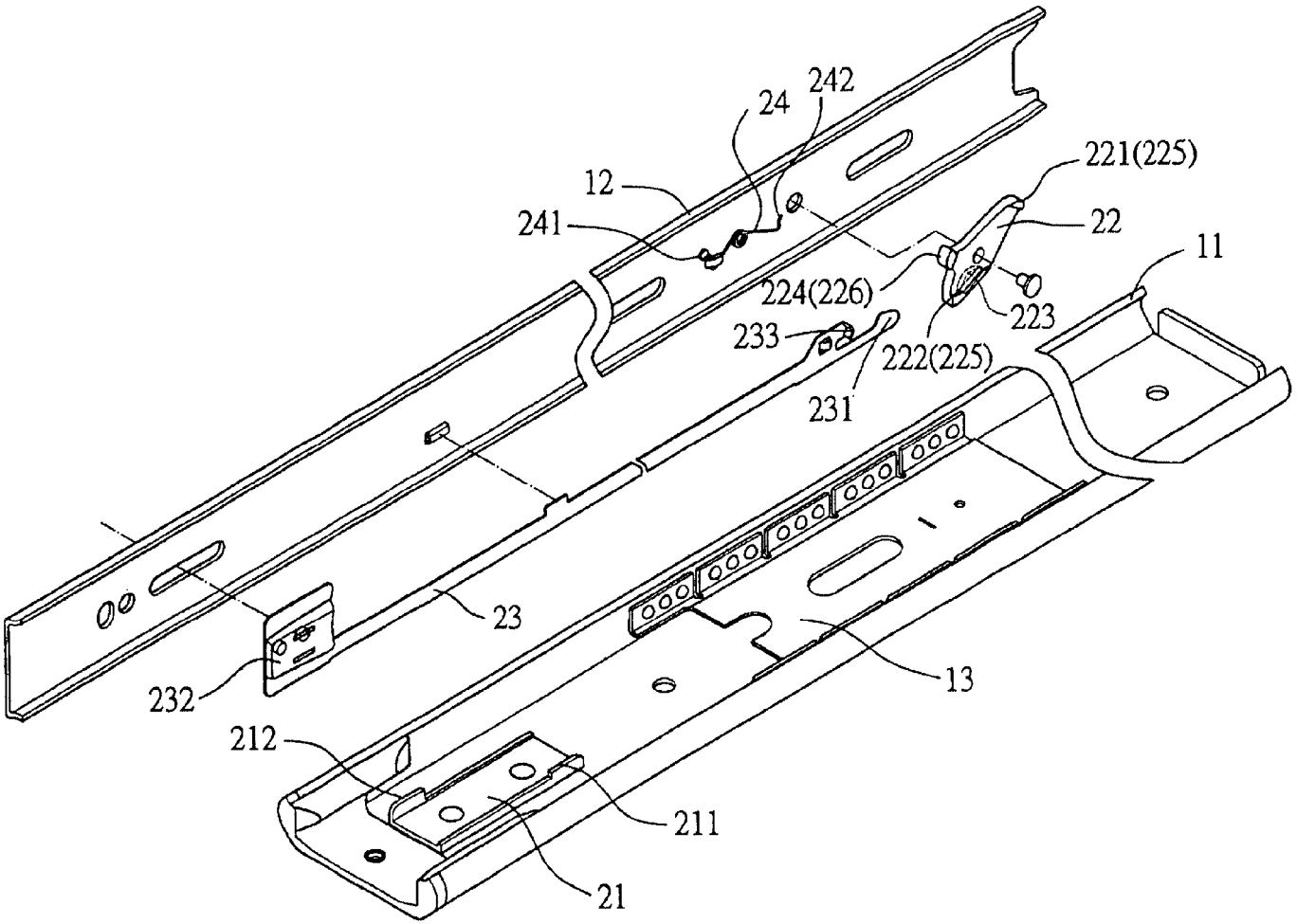
FIG. 3 is an exploded perspective view of a first embodiment of a track device in accordance with the present invention.
Figure 4:
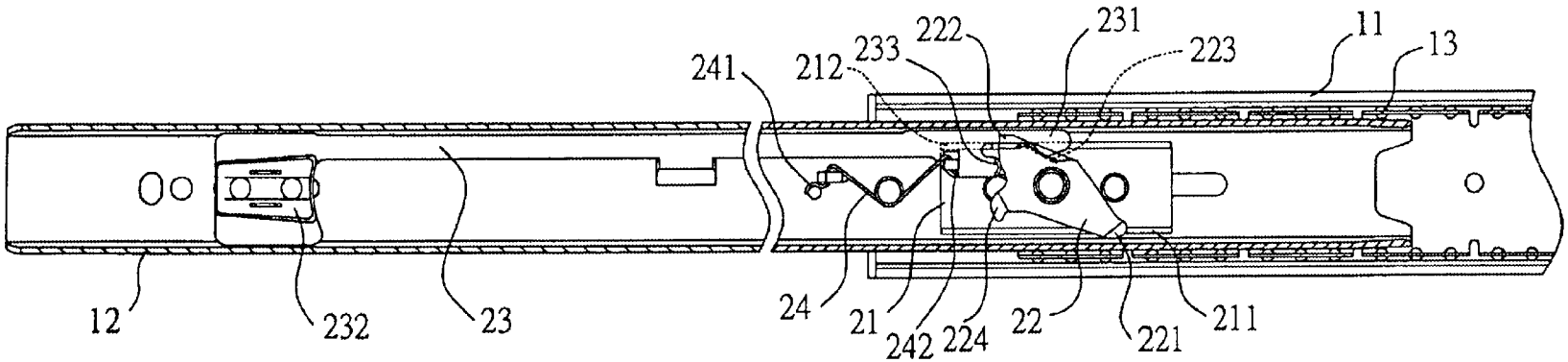
FIG. 4 is an elevational view of the track device in FIG. 3, the elements for retaining purposes being shown by solid lines for clarity.

Referring to FIGS. 3 and 4, a first embodiment of a track device in accordance with the present invention includes a first track 11 having a stop member 21 mounted thereon and a second track 12 having a limiting member 22 mounted thereon. The limiting member 22 in this embodiment is a substantially rhombic metal plate pivotally mounted to a side of the second track 12 facing the first track 11. The limiting member 22 includes two cams 221 and 222 respectively on two opposed acute-angled corners or corner portions 225 thereof for respectively cooperating with two stops 211 and 212 respectively formed on two sides of the stop member 21. The stop 212 of the stop member 21 is more adjacent to an outer end (or front end) of the first track 11 than the stop 211 is. The cam 222 of the limiting member 22 is more adjacent to the outer end of an outer end (or front end) of the second track 12 than the cam 221 is.

A slide-aiding member 13 is mounted between the first track 11 and the second track 12, allowing smooth sliding movement between the first track 11 and the second track 12. A groove 223 is defined in an inner side of the cam 222. A safety element 224 is formed on one of two obtuse-angled corners or corner portions 226 of the limiting member 22 that is more adjacent to the outer end of the second track 12 than the other obtuse-angled corner. The track device further includes a connecting rod 23 mounted to the second track 12. The connecting rod 23 has a first end on which a release cam 231 is formed, an operative second end 232, and a return cam 233 formed thereon. The release cam 231 abuts against a wall delimiting the groove 223 of the limiting member 22 such that the limiting member 22 pivots counterclockwise when the connecting rod 23 is pulled outward. An elastic element 24 has a first end 241 attached to the second track 12 and a second end 242 attached to the return cam 233. The elastic element 24 biases the return cam 233 of the connecting rod 23 to a position shown in FIG. 7 to thereby press against the cam 222 of the limiting member 22 when the second track 12 is not in its extended position shown in FIG. 4.

Figure 5:
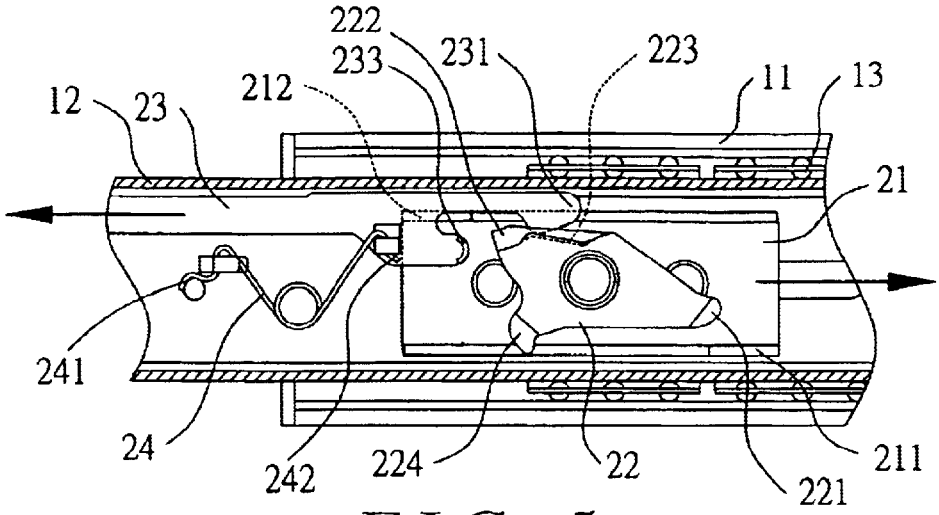
FIG. 5 is a view similar to FIG. 4, illustrating a first step of unlatching operation.

FIGS. 4 and 5 illustrate a first step of an unlatching operation of the track device in accordance with the present invention. As illustrated in FIG. 4, when the second track 12 is pulled outward to the extended position, the return cam 233 of the connecting rod 23 is biased by the elastic element 24 to thereby retain the limiting member 22 in a latching position in which the cam 221 of the limiting member 22 is engaged with the stop 211 of the stop member 21 and the cam 222 of the limiting member 22 is engaged with the stop 212 of the stop member 21, providing a dual-directional retaining function. Further, the safety element 224 of the limiting member 22 is not in use. As illustrated in FIG. 5, when a user grasps the operative second end 232 of the connecting rod 23 and pulls the connecting rod 23 outward, the elastic element 24 is compressed, the limiting member 22 pivots counterclockwise such that the cams 221 and 222 respectively disengage from the stops 211 and 212. The safety element 224 has not yet come into contact with the stop 211 but has turned to a level the same as that of the stop 211.

Figure 6:
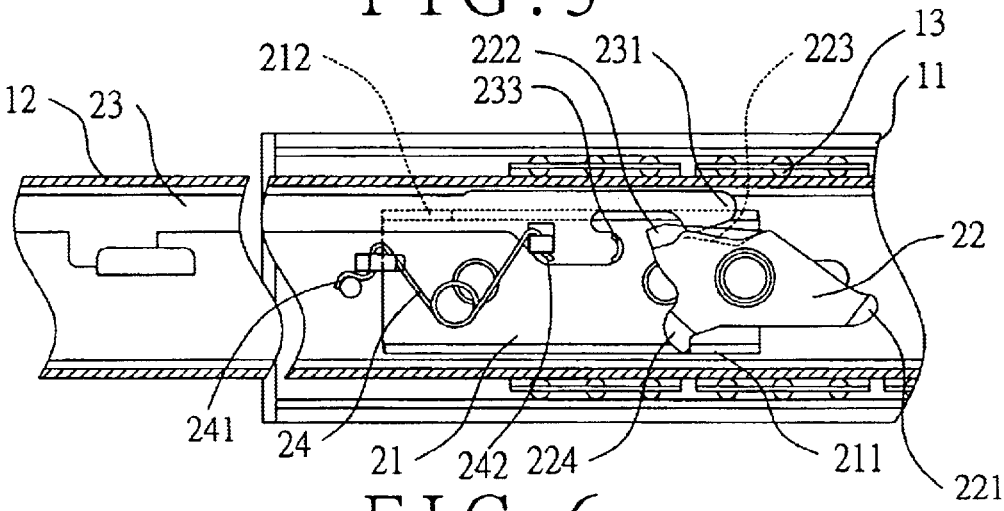
FIG. 6 is a view similar to FIG. 4, illustrating a second step of unlatching operation.
Figure 7:
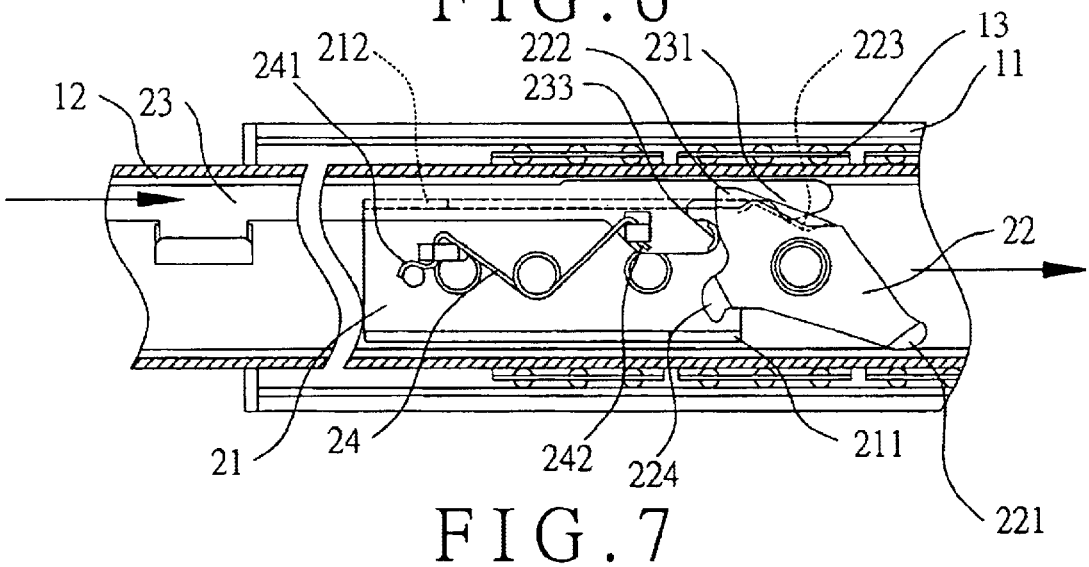
FIG. 7 is a view similar to FIG. 4, wherein the unlatching operation is completed.

Referring to FIG. 6, when the safety element 224 of the limiting member 22 of the second track 12 and the stop 211 of the first track 11 are on the same level and when the user moves the second track 12 inward, the limiting member 22 is moved synchronously with the second track 12. Thus, the safety element 224 comes in contact with the stop 211 of the stop member 21, which prevents further inward movement of the second track 12 and avoids the potential injury to the user's fingers. Referring to FIG. 7, when the fingers grasping the operative second end 232 of the connecting rod 23 are released, the elastic element 24 returns to its initial position and moves the return cam 233 to its initial position; namely, the limiting member 22 pivots back to a position shown in FIG. 7. Thus, user may push the second track 12 further inward with his or her fingers off the connecting rod 23. Since the cam 221 of the limiting member 22 has already passed through the stop 211 of the stop member 21, the second track 12 smoothly slide into the first track 11 without the risk of injury to the user's fingers.

Figure 8:
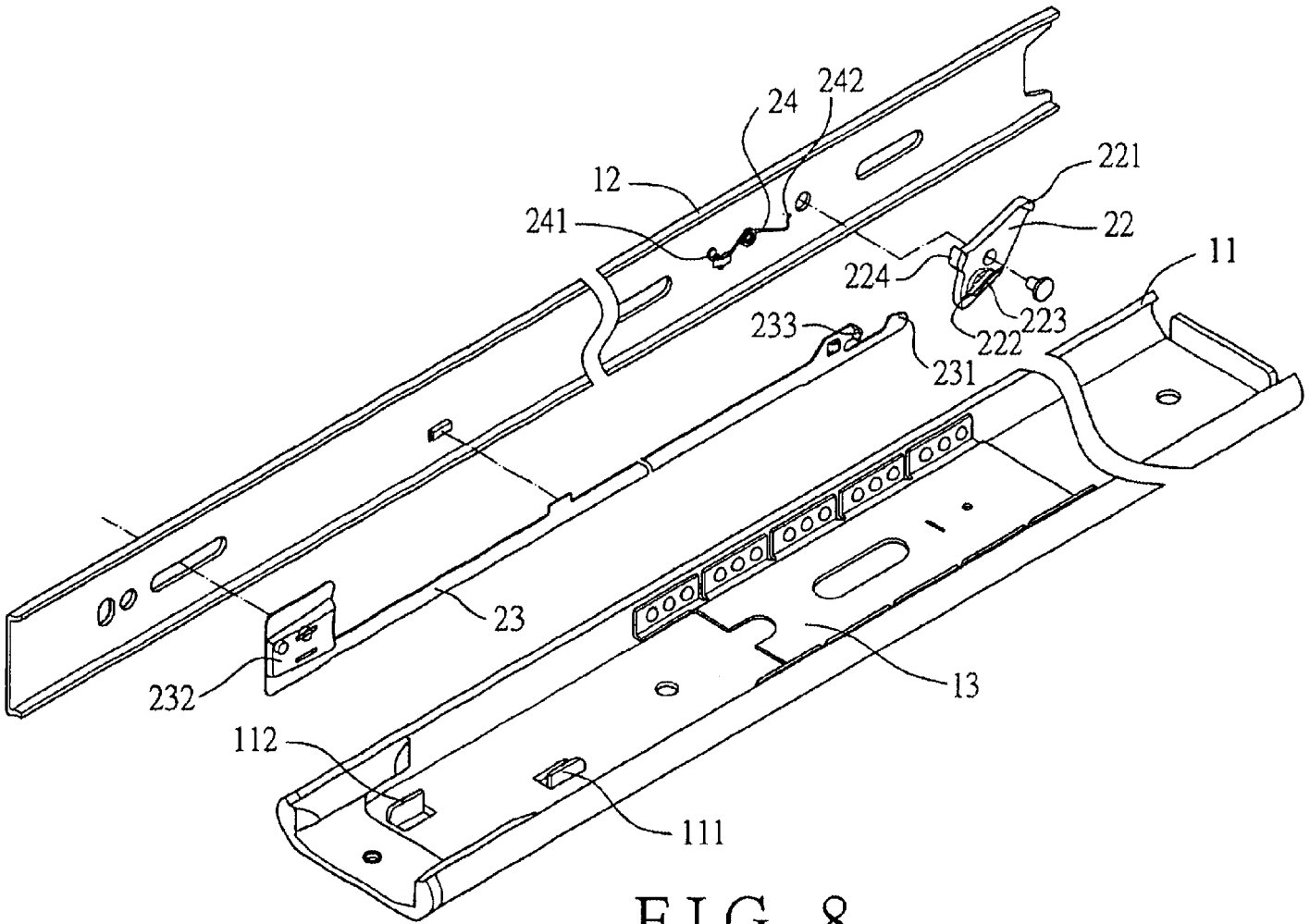
FIG. 8 is an exploded perspective view of a second embodiment of the track device in accordance with the present invention.

FIG. 8 illustrates a second embodiment of the track device in accordance with the present invention, wherein the stops (now designated by 111 and 112) are formed on the first track 11 by means of direct punching to replace the stops 211 and 212 of the stop member 21. Thus, the stops 111 and 112 not only temporarily retains the safety element 224 of the limiting member 22 for reminding the user to remove his or her fingers but also reduces the number of the elements required for the track device, the time for assembling the track device, and the cost for manufacturing the track device.

According to the above description, it is appreciated that by means of providing a safety element 224 on the limiting member 22, the user will be reminded to remove his or her fingers through engagement between the safety element 224 and the stop 211 of the stop member 21 when the connecting rod 23 is manually pulled for unlatching purposes. The risk of injury to the fingers of the user is avoided accordingly.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A track device comprising:

a first track;

a second track slidably received in the first track;

a stop member fixed on the first track and including two stops;

a limiting member pivotally mounted to the second track and including two cams for respectively and releasably engaging with the stops of the stop member, a safety element being provided between the cams of the limiting member;

a connecting rod mounted on the second track, the connecting rod being operatively connected to the limiting member for switching the limiting member between an unlatching position and a latching position;

wherein when the second track is located in an extended position relative to the first track, the cams of the limiting member are respectively engaged with the stops of the stop member for preventing the second track from being moved relative to the first track in either direction;

wherein when a user manually operates the connecting rod to move the limiting member from the latching position to the unlatching position, the safety element of the limiting member comes in contact with one of the stops of the stop member when the second track is moved from the extended position into the first track and when the connecting rod is pulled; and wherein the limiting member is a substantially rhombic plate having two acute-angled corners and two obtuse-angled corners, the cams of the limiting member being respectively formed on the acute-angled corners, and the safety element being formed on one of the obtuse-angled corners.

2. The track device as claimed in claim 1, wherein the connecting rod includes a first end of which a release cam is formed, an operative second end, and a return cam.

3. The track device as claimed in claim 2, wherein the first track further has an elastic element for biasing the return cam of the connecting rod to press against the limiting member, thereby retaining the limiting member in the latching position when the second track is in the extended position.

4. The track device as claimed in claim 3, wherein the limiting member further includes a groove, the release cam of the connecting rod abuts against a wall delimiting the groove of the limiting member such that the limiting member pivots when the connecting rod is pulled outward to thereby switch the limiting member from the latching position to the unlatching position.

5. The track device as claimed in claim 3, wherein the cams of the limiting member are respectively disengaged from the stops of the stop member when the limiting member is moved to the unlatching position as a result of grasping the operative second end of the connecting rod by the user's fingers.

6. The track device as claimed in claim 5, wherein the safety element is in contact with one of the stops of the stop member when the second track is moved from the extended position into the first track while the user's fingers grasp the operative second end of the connecting rod, thereby preventing further inward sliding movement of the second track into the first track.

7. The track device as claimed in claim 6, wherein the second track is allowed to slide further inward into the first track when the user's fingers detach from the second operative end of the connecting rod.

8. The track device as claimed in claim 7, wherein the return cam of the connecting rod is biased by the elastic element to press against one of the cams of the limiting member, thereby retaining the limiting member in the latching position when the second track is in the extended position.

9. The track device as claimed in claim 1, wherein the stops are directly formed on the first track by punching.

10. A track device comprising:

a first track;

a second track slidably received in the first track;

a stop member fixed on the first track and including two stops;

a limiting member pivotally mounted to the second track and including two cams for respectively and releasably engaging with the stops of the stop member, a safety element being provided between the cams of the limiting member, said limiting member comprises a pair of opposite first corner portions and a second corner portion, each of the cams of the limiting member respectively is formed on either of the first corner portions, and the safety element of the limiting member is formed on the second corner portion; and a connecting rod mounted on the second track, the connecting rod being operatively connected to the limiting member for switching the limiting member between an unlatching position and a latching position;

wherein when the second track is located in an extended position relative to the first track, the cams at the first corner portions of the limiting member are respectively engaged with the stops of the stop member for preventing the second track from being moved relative to the first track in either direction; and wherein when a user manually operates the connecting rod to move the limiting member from the latching position to the unlatching position, the safety element at the second corner portion of the limiting member comes in contact with one of the stops of the stop member when the second track is moved from the extended position into the first track and when the connecting rod is pulled.

11. The track device as claimed in claim 10, wherein the limiting member is a substantially rhombic plate comprising two acute-angled corners and two obtuse-angled corners, the cams of the limiting member being respectively formed on the acute-angled corners, and the safety element being formed on one of the obtuse-angled corners.

* * * * *